United States Patent [19]

Alexander

[11] 4,383,345

[45] May 17, 1983

[54] HAND-HELD BUFFING-POLISHING MACHINE

[76] Inventor: John D. Alexander, Rte. 1, Box 95-B, Sheffield, Ala. 35660

[21] Appl. No.: 203,318

[22] Filed: Nov. 3, 1980

[51] Int. Cl.[3] ..... A46B 13/04

[52] U.S. Cl. ..... 15/97 R; 15/29

[58] Field of Search ..... 15/24, 29, 49 R, 50 R, 15/97 R, 98, 230.16; 56/12.7

[56] References Cited

U.S. PATENT DOCUMENTS

| | | | |
|---|---|---|---|
| 816,685 | 4/1906 | Sevier | 15/29 X |
| 1,625,792 | 4/1927 | Carrington | 15/29 |
| 1,730,030 | 10/1929 | Bernstein | 15/29 X |
| 2,756,446 | 7/1956 | Chittum | 15/29 |
| 3,443,272 | 5/1969 | Trelc et al. | 15/29 |
| 3,531,815 | 10/1970 | Moss et al. | 15/230.16 |
| 3,826,068 | 7/1974 | Ballas | 56/12.7 |
| 4,208,753 | 6/1980 | Lewis | 15/29 |
| 4,238,866 | 12/1980 | Taylor | 15/92 |

FOREIGN PATENT DOCUMENTS

| | | | |
|---|---|---|---|
| 111198 | 11/1928 | Austria | 15/29 |

*Primary Examiner*—Edward L. Roberts
*Attorney, Agent, or Firm*—C. A. Phillips

[57] ABSTRACT

A hand-held buffing-polishing machine wherein a driven shaft which rotates a pliable buffing or polishing working medium is hollow, and a liquid agent facilitating buffing or polishing is coupled to the hollow shaft through a collar around the shaft and thence to the working medium and work piece.

3 Claims, 6 Drawing Figures

HAND-HELD BUFFING-POLISHING MACHINE

TECHNICAL FIELD

This invention relates to a hand-held device for cleaning, buffing or polishing, and particularly to a device of this character wherein a work facilitating or enhancing liquid is fed to the surface of the buffing or polishing work engaging medium.

BACKGROUND ART

It is common practice to apply liquid and polishing agents to a work piece being operated on by a hand-held buffing-polishing machine. These machines typically employ a yieldable material, such as a fabric, attached to a rotating face of the machine which is of a selected texture, depending upon the desired surfacing effect. At present, the user of such a machine will first and separately apply a liquid to a work piece and then pick up the machine, turn it on and operate the machine over the area to which the liquid agent has been applied. While this two-step approach is reasonably satisfactory in some instances, particulary where it is desired to allow the liquid agent to dry or harden on the work piece, it is often not satisfactory when the liquid is to be utilized in its liquid form. First, the procedure is too time-consuming, and second, it is often difficult to apply and confine the liquid to a precise work area, as the liquid agent may run off and not be effectively utilized. This is particularly true where the surface being worked on is not level.

Accordingly, it is the object of this invention to overcome these problems.

DISCLOSURE OF THE INVENTION

In accordance with this invention, the drive shaft of the motor assembly of a hand-held buffer-polisher unit is provided with an axial opening extending to an end to which is attached a work surface engaging means. A rotary fluid coupling is attached to the shaft, and coupled to the opening, and through it, a desired working fluid is fed. A hand-operated valve is provided, whereby the operator of the machine can readily meter out a desired quantity of fluid.

BEST MODE FOR CARRYING OUT THE INVENTION

Figure 2:
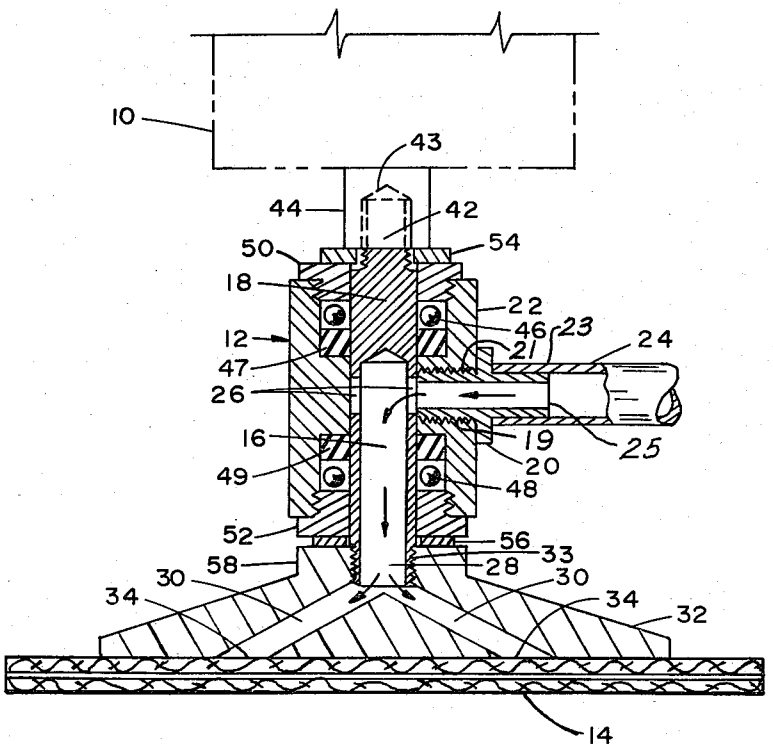
FIG. 2 is a partial sectional view taken along line 2—2 of FIG. 1.
Figure 1:
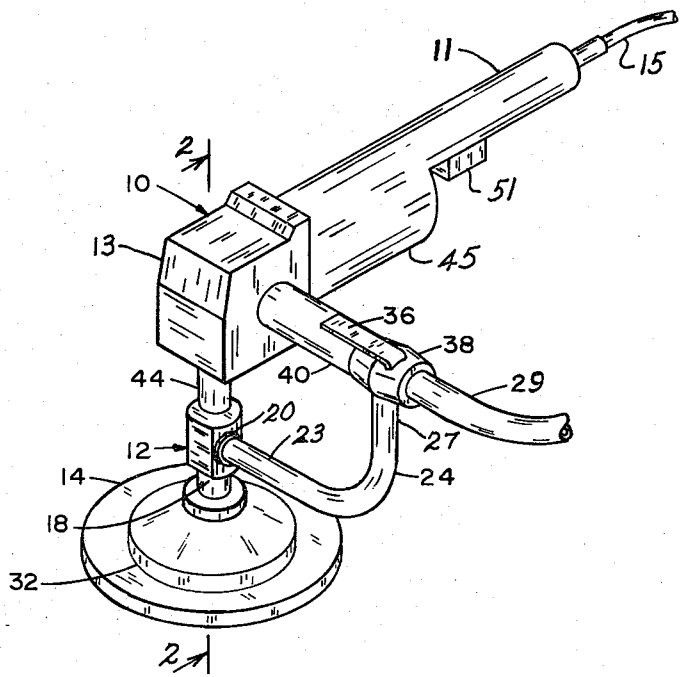
FIG. 1 is a pictorial representation of a preferred embodiment of the invention.

Referring initially to FIGS. 1 and 2, polishing or buffing machine 10 is constructed having a conventional handle region 11 with a swivel coupling assembly 12, which is mounted around rotating shaft 18, and which allows a fluid, such as liquid polishing or waxing compound, to be applied to a conventional absorbent buffing or polishing pad 14. A cloth or other thread-bearing material is often used. The liquid is conveyed through the hollow portion 16 of shaft 18. Machine 10 is conventional, including a right-angle drive in housing 13 driven by motor 45 from power cord 15.

The threaded end 19 of nipple 20 is inserted into the corresponding tapped hole 21 in body 22 of coupling assembly 12. An end 23 of flexible hose 24 is attached to the other end 25 of nipple 20 (by means not shown). The other end 27 of hose 24 is attached to valve assembly 38 (FIG. 1), which is mounted to the end of handle 40 of polishing machine 10 (by means not shown). Flexible hose 29 (FIG. 1) extends from valve assembly 38 to a conventional liquid reservoir (not shown). The flow of fluid to machine 10 is typically controlled by depressing and releasing manual lever 36 of valve assembly 38 (FIG. 1). The fluid is admitted to the hollow portion 16 of shaft 18 through drilled holes 26 in the outside walls of shaft 18. The fluid flows down the inside of the shaft and out open end 28 into metering holes 30 which are drilled in face plate 32 and which distribute the fluid to absorbent pad 14 at points 34. Face plate 32 is mounted to threaded end 33 of shaft 18 (as shown). Upper end 42 of shaft 18 is threaded and screws into tapped hole 43 in the end of shaft 44 of motor 45. Shaft 18 thus rotates integrally with output shaft 44 when the motor of machine 10 is turned on by switch 51, through which power is applied from power cord 15. Coupling assembly 12 is mounted to machine 10 in a fixed position (by means not shown) so that it does not rotate, while allowing shaft 18 to rotate freely. The fluid readily flows into the hollow portion of shaft 18 while it is rotating through holes 26, as previously noted. Shaft 18 is typically supported by bearings 46 and 48, which are typically held in place in coupling body 22 by threaded bearing caps 50 and 52. Leakage is prevented by conventional packings 47 and 49. Washer 54 is placed between rotating shaft 44 and fixed bearing cap 50, while washer 56 is placed between base 58 on rotating face plate 32 and fixed bearing cap 52. The arrangement shown in FIGS. 1 and 2 allows the system covered by this invention to be readily adapted to standard polishing and buffing machines.

Figure 3:
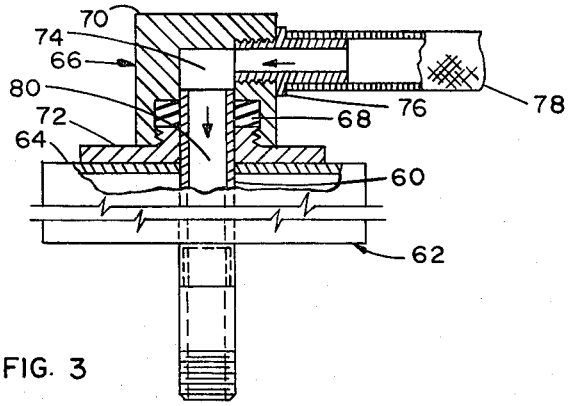
FIG. 3 is a partial view showing a modification of the invention wherein the fluid is applied through the top of the machine.

A modification of this invention is shown in FIG. 3 wherein the rotating output shaft 60 of a polishing or buffing machine 62 is hollow through its entire length and extends typically ¾ inch above top 64 of the machine. A coupling assembly 66 is mounted to top 64 (by means not shown). The fluid is admitted into cavity 74 of coupling body 70 through nipple 76, which screws into the side of coupling body 70 (as shown). The liquid flows from cavity 74 into open end 80 of output shaft 60 and all the way through the shaft to an opposite, threaded end (not shown, but like threaded end 33 of shaft 18, as shown in FIG. 2), which is thus attachable to a pad 14 (FIG. 2). Seal 68 is typically held in coupling body 70 by threaded retainer 72 in such a way that the liquid cannot flow down the outside of shaft 60 into the gear train of the machine (not shown). Flexible hose 78 connects nipple 76 to a fluid flow control valve and fluid reservoir (not shown). This embodiment of the invention allows the use of a less complex swivel coupling in that no additional bearings external to machine 62 are required, and a single seal 68 would normally be sufficient. Flow may be controlled by an in-line valve, e.g., a valve 38 (as shown in FIG. 1).

Figure 4:
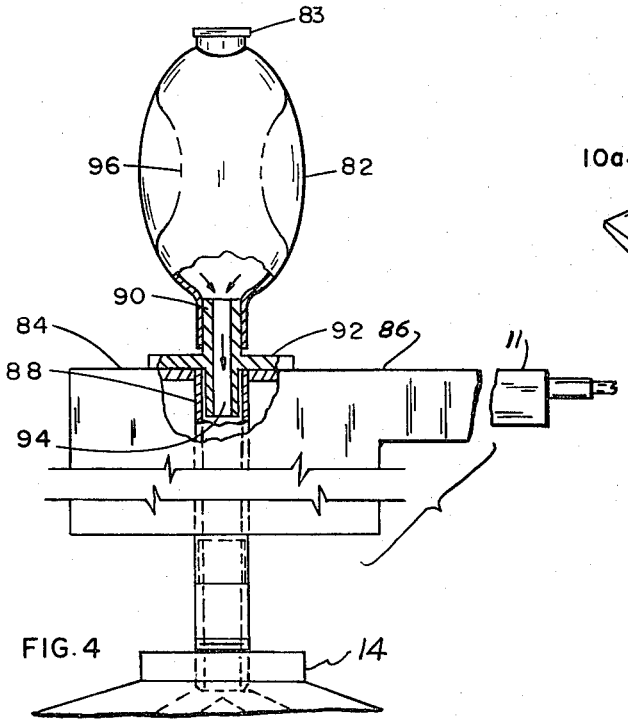
FIG. 4 is a partial view showing a modification of the invention wherein the fluid is applied by means of a squeeze bulb.

Another modification of this invention is shown in FIG. 4 wherein a flexible reservoir 82 is mounted to top 84 of a polishing or buffing machine 86 of the type illustrated in FIG. 3. Rotating output shaft 88 of machine 86 is hollow throughout its entire length. The top of shaft 88 is typically flush with top 84 of machine 86. Nipple 92 is mounted to top 84 of machine 86 (by means not shown). Reservoir 82 is bonded to top barrel 90 of nipple 92 (as shown). Lower barrel 94 of nipple 92 typically extends ½ inch downward inside the open end of hollow output shaft 88, with sufficient clearance to allow shaft 88 to rotate freely. When flexible reservoir 82 is squeezed, for example, to position 96, fluid is forced out of the reservoir, through nipple 92, and into hollow shaft 88. The fluid then flows all the way down the inside of the shaft to a threaded end (as shown by end 33 of FIG. 2) which attaches to a pad 14 (FIG. 2) mounted thereon. Reservoir 82 is refillable through filler cap 83.

Figure 5:
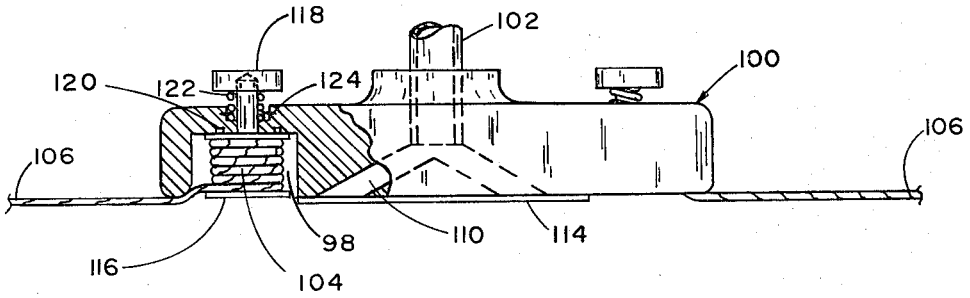
FIG. 5 is a partial view showing a modification of the invention wherein the machine is used to remove paint and other coatings.

Yet another modification of this invention is shown in FIG. 5 wherein the rotating member provides a whirling line, cable or cord, and is used to remove paint, varnish, rust, barnacles, or accumulations of other materials from generally flat or gently curved surfaces.

Cavities 98 are cut in face plate 100, which is thread mounted to the threaded end of hollow output shaft 102 (threaded as shown for shaft 18 of FIG. 2) of a machine (as per FIGS. 1–4). Flexible cable or cord members 104 are coiled on spools 116 inside cavities 98, with the loose ends 106 of the cords or cables typically extending 5 to 12 inches outward from the perimeter of face plate 100. When face plate 100 is rotated by turning on the polishing machine motor (not shown), loose ends 106 rapidly and repeatedly flail or otherwise impact the surface to be cleaned, mechanically dislodging or displacing the coating or other material to be removed. As the tips of loose ends 106 wear off, additional cord or cable is metered out from spools 116 inside cavities 98 by depressing knobs 118, thus disengaging locking pins 120 and allowing spools 116 to be rotated to meter out additional cord or cable. To replenish cords or cables 104, knobs 118, which are threaded onto the end of spools 116, are removed (locking pins 120 prevent spools 116 from rotating), allowing spools 116 to be removed and cords or cables replenished. Springs 122 are retained in face plate 100 by retainers 124. As spools 116 are inserted back into cavities 98, locking pins 120 engage and allow knobs 118 to be reinstalled. Springs 122, acting between knobs 118 and face plate 100, retain spools 116 in the locked position.

Figure 6:
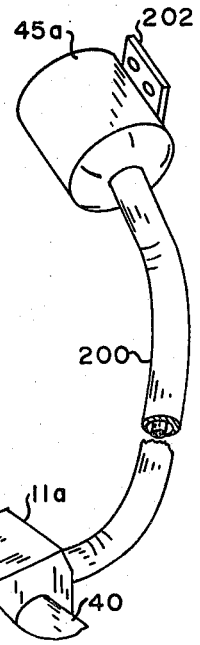
FIG. 6 is a partial pictorial view of still another modification of the invention.

Yet another modification of the invention is shown in FIG. 6. It comprises a grinder-polisher machine **10*a* having a conventional right-angle drive within housing 11*a*, as in the case of machine 10 in FIG. 1. It differs, however, in that the right-angle drive is driven by a flexible shaft 200, in turn driven by a remotely located motor 45*a* attached to a support (not shown) by motor bracket 202. Machine 10*a* would have an output shaft 44, as in the case of machine 10 shown in FIGS. 1 and 2, and otherwise would be the same and would function in the same manner as that embodiment. Alternately, the drive shaft may be hollow as per shaft 60 of FIG. 3** and axially align with a flexible and hollow drive shaft and motor shaft through which fluid would be introduced.

To speed up or otherwise facilitate the removal of coatings, a liquid softening or loosening compound is applied through hollow output shaft 102 and metering holes 110 to pad 114 (FIG. 5). The liquid would be supplied to shaft 102 by any of the means shown in FIGS. 2, 3, and 4.

From the foregoing, it is to be appreciated that this invention provides a new and improved hand-operated rotary cleaning and polishing machine. It eliminates the necessity of separately applying a liquid agent to a work piece and enables more accurate control of both the position and quantity of liquid which is applied.

I claim:

1. A surfacing machine comprising:

a frame, including a hand-holding extension of said frame;

a rotable drive machine supported on said frame and including an electrical motor and a driven, rotating, hollow shaft, at right angles to said hand extension, said shaft extending out of said machine at opposite ends, and said shaft having a fluid receiving opening at one end and a threaded region and a fluid dispensing opening at an opposite end;

a stationary-to-rotary fluid coupling supported by said frame and having a fixed fluid receiving member rotably coupled to the fluid receiving end of said shaft;

a compressible bulb coupled in a stationary mode to said stationary-to-rotary fluid coupler and being coupled through said coupling in line with said hollow shaft; and a work engaging member having openings therethrough and having a threaded region engaging the threaded end of said hollow shaft and supported thereon.

2. A machine as set forth in claim 1 further comprising a work piece medium, wherein said work piece medium comprises a thread-bearing material.

3. A machine as set forth in claim 1 further comprising a work piece medium, in turn comprising at least one strand of line, and said mounting includes at least one reel for storing and feeding out said line from said reel.

* * * * *